US005166465A

United States Patent [19]

Jeon et al.

[11] Patent Number: 5,166,465

[45] Date of Patent: Nov. 24, 1992

[54] DUET-SOUND GENERATING METHOD FOR AN ELECTRONIC MUSICAL INSTRUMENT

[75] Inventors: Ik-Bom Jeon, Suwon; Young-Man Lee, Seoul, both of Rep. of Korea

[73] Assignee: SamSung Electronics Co., Ltd., Suweon, Rep. of Korea

[21] Appl. No.: 424,814

[22] Filed: Oct. 20, 1989

[30] Foreign Application Priority Data

Dec. 31, 1988 [KR] Rep. of Korea ..... 1988-18089

[51] Int. Cl.[5] ..... G10H 7/10; G10H 1/38

[52] U.S. Cl. ..... 84/669; 84/637; 84/650; 84/715

[58] Field of Search ..... 84/601, 602, 613, 662, 84/664, 682, 701, 708, 637, 650, 669, 715, DIG. 9, DIG. 22

[56] References Cited

U.S. PATENT DOCUMENTS

| | | | |
|---|---|---|---|
| Re. 29,144 | 3/1977 | Bunger | 84/637 |
| 3,708,602 | 1/1973 | Hiyama . | |
| 3,789,718 | 2/1974 | Bunger . | |
| 3,922,943 | 12/1975 | Niinomi | 94/DIG. 20 X |
| 4,240,317 | 12/1980 | Kmetz | 84/617 |
| 4,282,788 | 8/1981 | Yamaga et al. | 84/DIG. 22 X |
| 4,287,804 | 9/1981 | Hirose | 84/DIG. 4 X |
| 4,315,452 | 2/1982 | Yoshinari . | |
| 4,429,606 | 2/1984 | Aoki | 84/664 |
| 4,470,332 | 9/1984 | Aoki | 84/850 X |
| 4,489,636 | 12/1984 | Aoki et al. | 84/637 X |
| 4,499,808 | 2/1985 | Aoki | 84/649 |
| 4,694,723 | 9/1987 | Shinohara et al. | 84/478 X |

*Primary Examiner*—William M. Shoop, Jr.
*Assistant Examiner*—Jeffrey W. Donels
*Attorney, Agent, or Firm*—Robert E. Bushnell

[57] ABSTRACT

There is disclosed a method of a dual filter duet-sound generating method, by allowing an electronic musical instrument with duet-note capability to simultaneously output a harmonious chord in an instrument voice different from that of the depressed melody keyboard note, each duet note being respectively output in different instrument's voice. The electronic musical instrument for carrying out the invention includes: a microputer 11 for control, a sound-generator IC 21 for generating a duet-sound, a plurality of instrument voice filters, a plurality of buffers connected between the sound-generator and the instrument voice filters, a plurality of inventers for control, a plurality of switches at the user interface, a musical keyboard, amplifiers, and a speaker to produce musical sounds.

8 Claims, 6 Drawing Sheets

DUET-SOUND GENERATING METHOD FOR AN ELECTRONIC MUSICAL INSTRUMENT

BACKGROUND OF THE INVENTION

This invention concerns a duet-sound generating method for use in an electronic musical instrument.

Generally, a duet-sound refers to an ensemble of notes. In other words, it may be a sound produced from incorporating a current melody note being played with a machine generated note or notes. To generate such a duet-sound note interval, as shown in FIG. 1, a conventional electronic musical instrument includes: a microcomputer 11 that controls related sound-source control data and generation thereof by inputting various control-switching signals and melody keyboard key switching signals; an auto-accompaniment switch 13, a duet switch 15, a filter selection switch 19, and a melody keyboard 17 that generates depressed key note signals. A sound-source generation integrated circuit (referred to as a sound-generator IC hereinafter) 21 generates related sound-source and chord sounds according to the chord and the sound-source control data from the microcomputer 11 and outputs them to the output terminals OUT1 and OUT2; a chord and bass filter 41 that, enabled under the control of the microcomputer, filters the output of the sound-generator IC's chord and bass; a rhythm generator a 43 generating rhythm signal under the microcomputer's control; a plurality of filters 45, 47 and 49 for filtering the sound-source output of the sound-generator IC 21; a pre-amplifier 51 that pre-amplifies the outputs of the filters; pre-amplifiers 53, 55 that pre-amplify the outputs of the chord and bass filter 41 and the rhythm generator 43; and a main amplifier 57 that amplifies the output of the pre-amplifiers 51, 53, 55 and outputs them to the speaker 59.

FIGS. 2*a* and 2*b* are flow chart for a conventional duet-sound generation, that is a program for use in the microcomputer 11 of FIG. 1. FIG. 2*a* represents the auto-accompaniment part and FIG. 2(*b*) is the non-auto-accompaniment. In auto-accompaniment mode's case, the duet sound is programmed to be produced when a melody note on the melody keyboard 17 of FIG. 1 is depressed and the duet switch 15 is turned 'on'. The conventional duet-sound generation procedure is explained in the following section with reference to FIGS. 1 and 2. When the Filter Selection switch 19 is switched to Filter 1, e.g., a piano-voice selection signal to the microcomputer 11, the microcomputer recognizes the Filter 1 selection condition (e.g., paino sound) performs key scanning and sends a logic high signal to the output terminal S1 to enable Filter 1, filter 45. If the auto-accompaniment switch 13 becomes "on" under such a condition, the microcomputer 11 recognizes the change by key-scanning activity and determines the current mode is auto-accompaniment on. It then sends chord data for the generation of chord sounds to the sound-generator IC 21 and outputs the chord and bass-filter enable signal and rhythm-enable "high" signal at terminal S8 to enable them. During this time, the sound-generator IC 21 produces and sends the related chord sound to the output terminal OUT2, which causes the chord and bass filter 41 to output the filtered chord sound. The enabled rhythm generator 43 produces a certain rhythm. The chord and rhythm signals generated above, go through respective pre-amplifiers 53 and 55 to be amplified to a certain level, mixed in the main amplifier 57, and finally sent to speaker 59. During operation, pressing a key on the melody keyboard 17 prompts the microcomputer to check if the duet switch 15 is on. If the duet switch 15 is "off", a channel is assigned to a key to produce a sound. But, with Duet Switch 15 on, the melody keyboard 17 is scanned for a root note for the output chord. As in the logic of FIG. 2*a*, if a melody keyboard note is depressed without the root note present data for the root note and the melody note are allocated to two channels to be inputted to the sound-generation IC 21. At the moment, the sound-generation IC 21 generates the sound source according to the microcomputer's data and sends it to the output terminal OUT1. The sound-generation IC's sequentially outputting the data allocated to the two channels by the microcomputer 11, thereby generating the duet sound. For example, if a chord currently being outputted is a C chord, a "Do" sound that is equivalent to the root note of the chord is allocated to one of the two channels and a "Mi" sound is allocated to the other one, thereby being outputted to the sound-generator IC's output terminal OUT1. The duet sound outputted from the sound-generator IC 21 is inputted to the enabled filter 45 to be then processed into a duet sound using Filter 1 upon for the sound of the output. On the other hand, if the result of the above checking operation shows that any melody keyboard note equivalent to the root note of the outputting chord is depressed, then the outputting chord is checked to see if it is major key or a minor key. Thereafter, data for harmonious the major or minor key responding note interval with respect to the depressed key, is sent to the sound-generator IC 21. The sound-generation IC 21, at this moment, produces the sound source corresponding to the above data and sends it to the filter 1, 45 to generate the duet sound.

The duet sound produced by the instrument of FIG. 1 according to the flow chart of FIGS. 2*a* and *b*, however, provides only a mono-tone single instrument voice sound, incapable of producing duet-sounds with various instrument voices. In other words, the method may accomplish the duet sound only with a sound of a single instrument.

SUMMARY OF THE INVENTION

Accordingly, an object of this invention is to provide a method of generating a duet-sound using two filters, by allowing an electronic musical instrument with duet-sound capability, to simultaneously output a harmonious chord in a voice different from that of the depressed melody keynotes notes, each of the duet sound notes being generated in a different instrument's voice.

According to an aspect of the invention, the preferred embodiment of the invention includes: a first step for enabling a plurality of filters in response to a filter control signal applied from the microcomputer; a second step for forming a signal path for applying a duet sound, which is harmonized by first and second melody keyboard notes, to the plurality of filters and checking if a melody keyboard key corresponding to a root note of the chord presently being generated is depressed; a third step for, if the root note in the second step is not being played then, generating a signal corresponding to the depressed key note and another signal corresponding to the root note of the chord presently being generated and applying the signals to the plurality of filters through the signal path formed in the second step; a fourth step for checking if the chord presently being generated is a major chord; a fifth step for, if the chord presently being generated is a major chord, controlling a microcomputer so as to output a sound generated by the depressed key note and another note to form a major-triad chord; a sixth step for, if the chord presently being generated is not the major chord in the fourth step, controlling the microcomputer so as to output the signal generated by the depressed key note and another sound to form a minor-triad chord to the output terminal of the sound-generator.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF THE PREFERRED EMBODIMENTS

With reference to the accompanying drawings, a preferred embodiment of the invention will now be explained hereinbelow, by way of an example.

Figure 1:
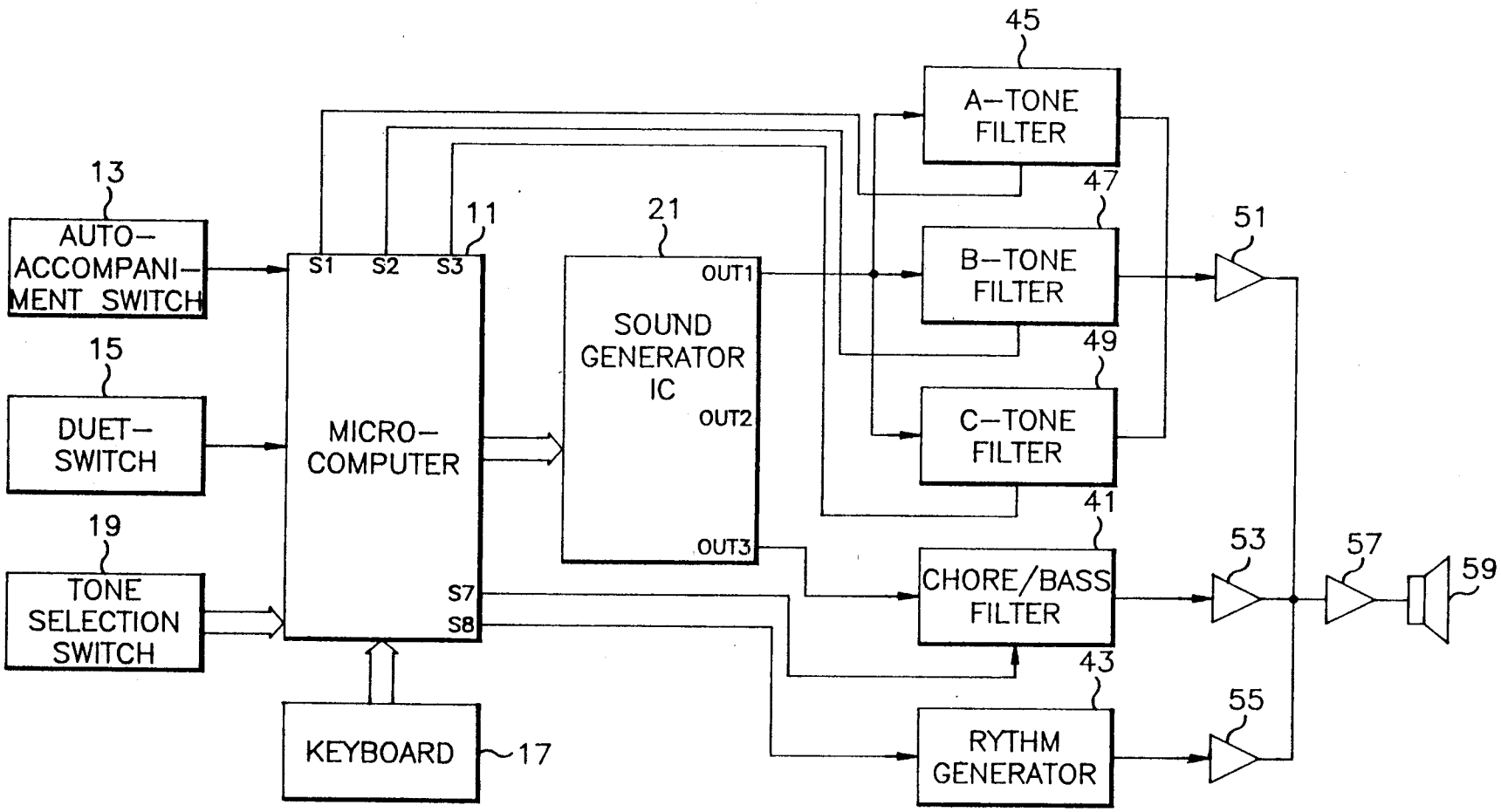
FIG. 1 shows the system diagram for a conventional electronic musical instrument.
Figure 2A:
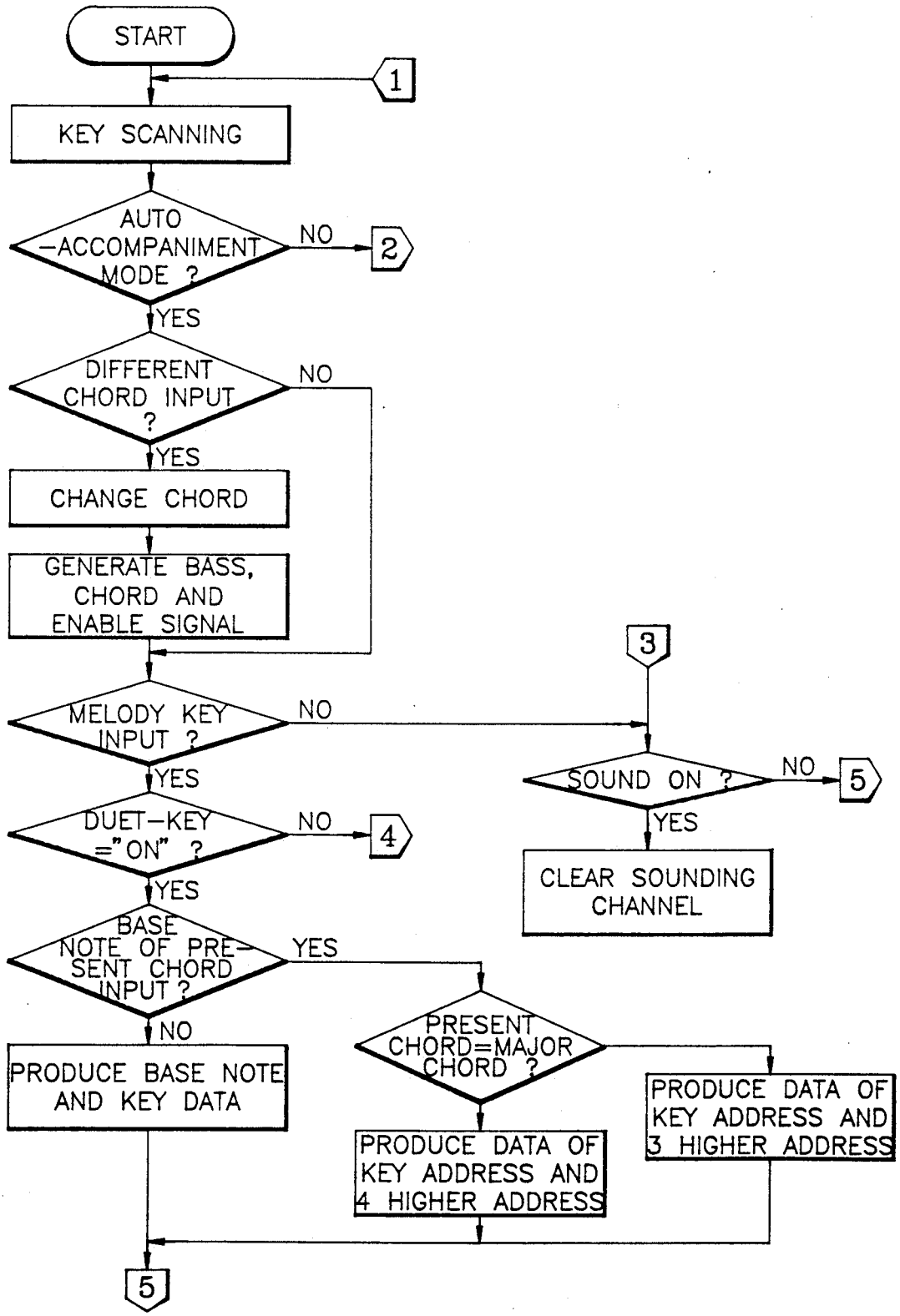
FIGS. 2(*a* and *b*) shows a flow chart for the conventional duet-sound generating circuit.
Figure 2B:
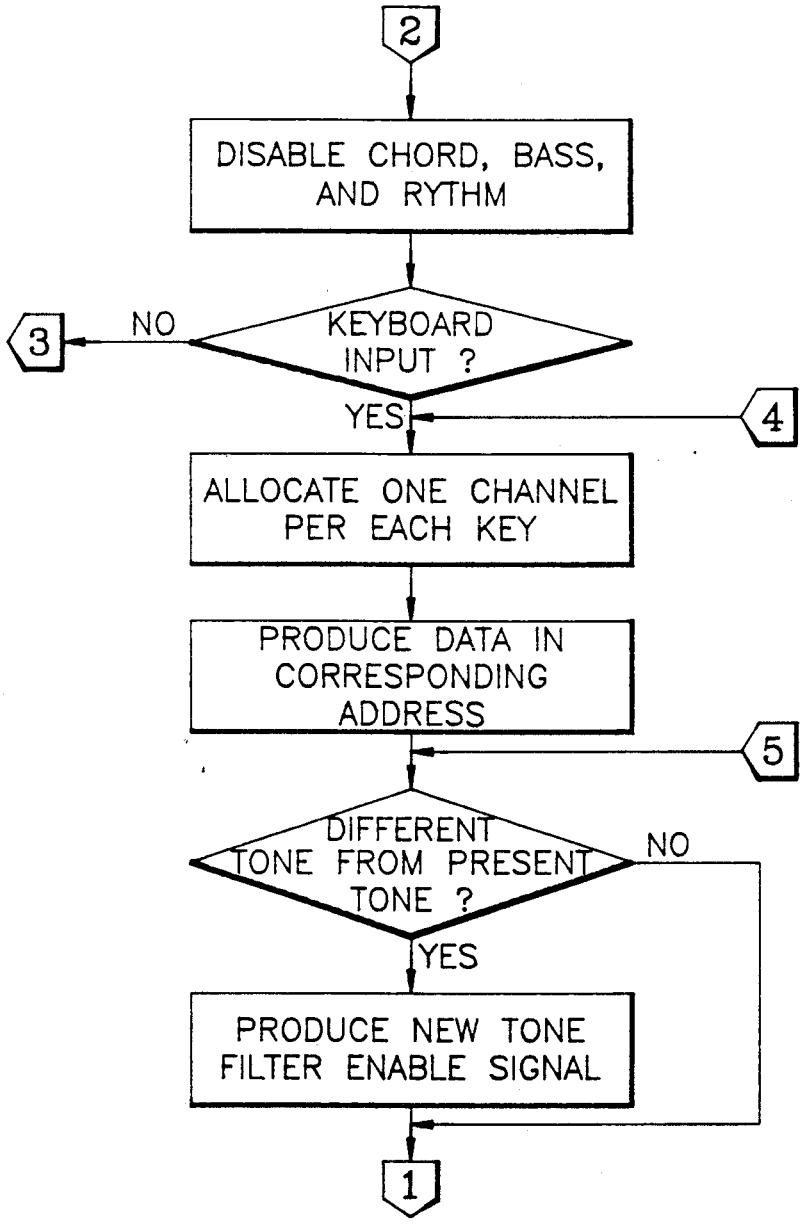
Figure 3:
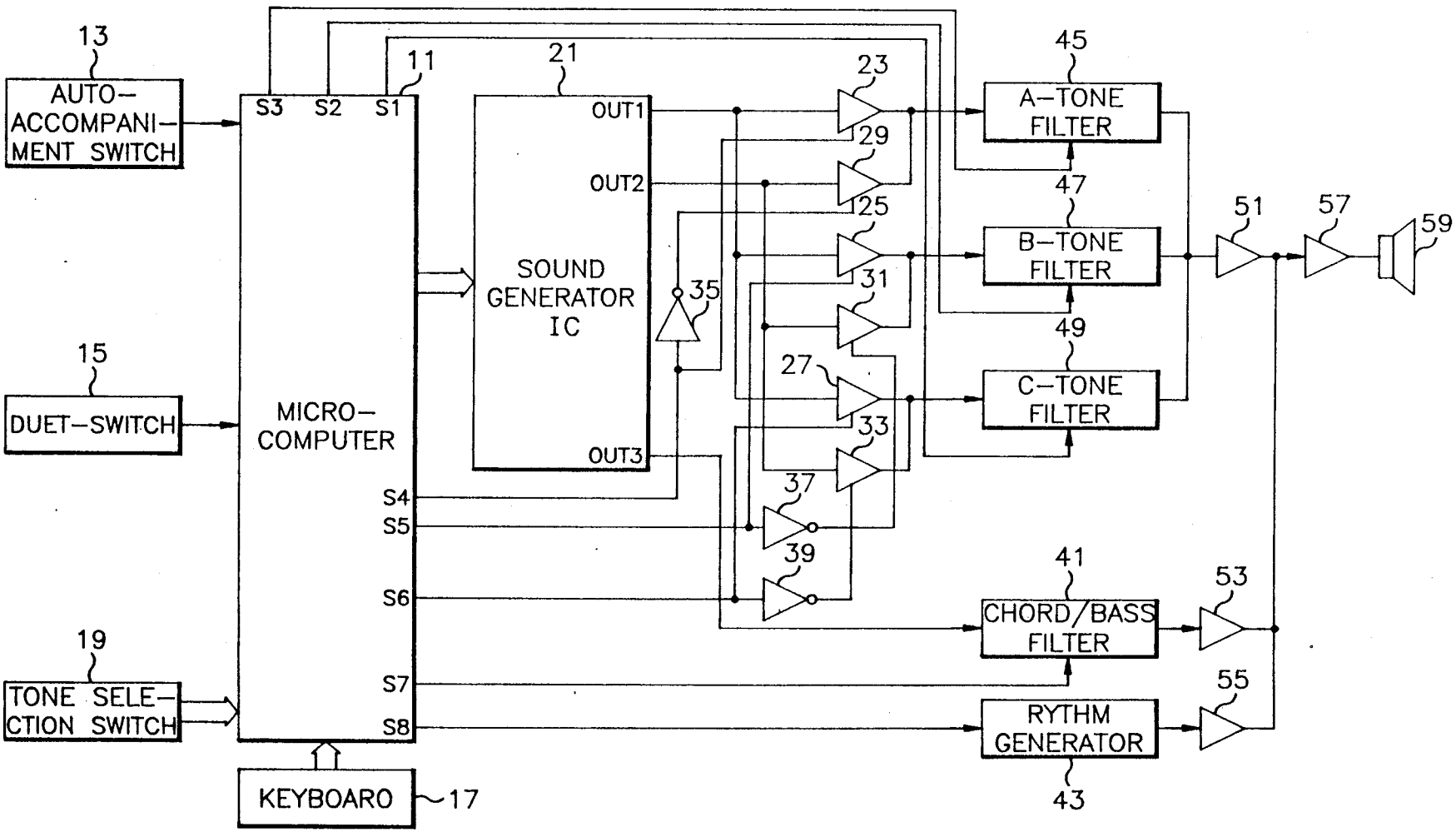
FIG. 3 shows a system block diagram for the electronic musical instrument according to the invention.

Referring first to FIG. 3 illustrating the system diagram of an embodiment for carrying out the inventive electronic musical instrument, an output terminal OUT1 of the sound-generator IC 21 is commonly connected to Filter One 45, Filter Two 47, and Filter Three 49 through a first, second, and third buffer 23, 25, 27, respectively which are enabled by a control signal from the microcomputer 11. Additionally, a fourth, fifth, and sixth buffer 29, 31, 33 are commonly connected to another output terminal OUT2 of the sound-generator IC 21, the buffers receiving the output signal of the sound-generator IC to output the signal to the filters in response to the control signal from the microcomputer 11. Moreover, first, second, and third inverters 35, 37, 39 which respectively invert output signals of output terminals S4, S5, S6, of the microcomputer and respectfully provides them, as enable signals, to the fourth, fifth and sixth buffers 29, 31, 33. On the other hand, the other numeral references and construction of the diagram are same as the those explained in FIG. 1.

Figure 4A:
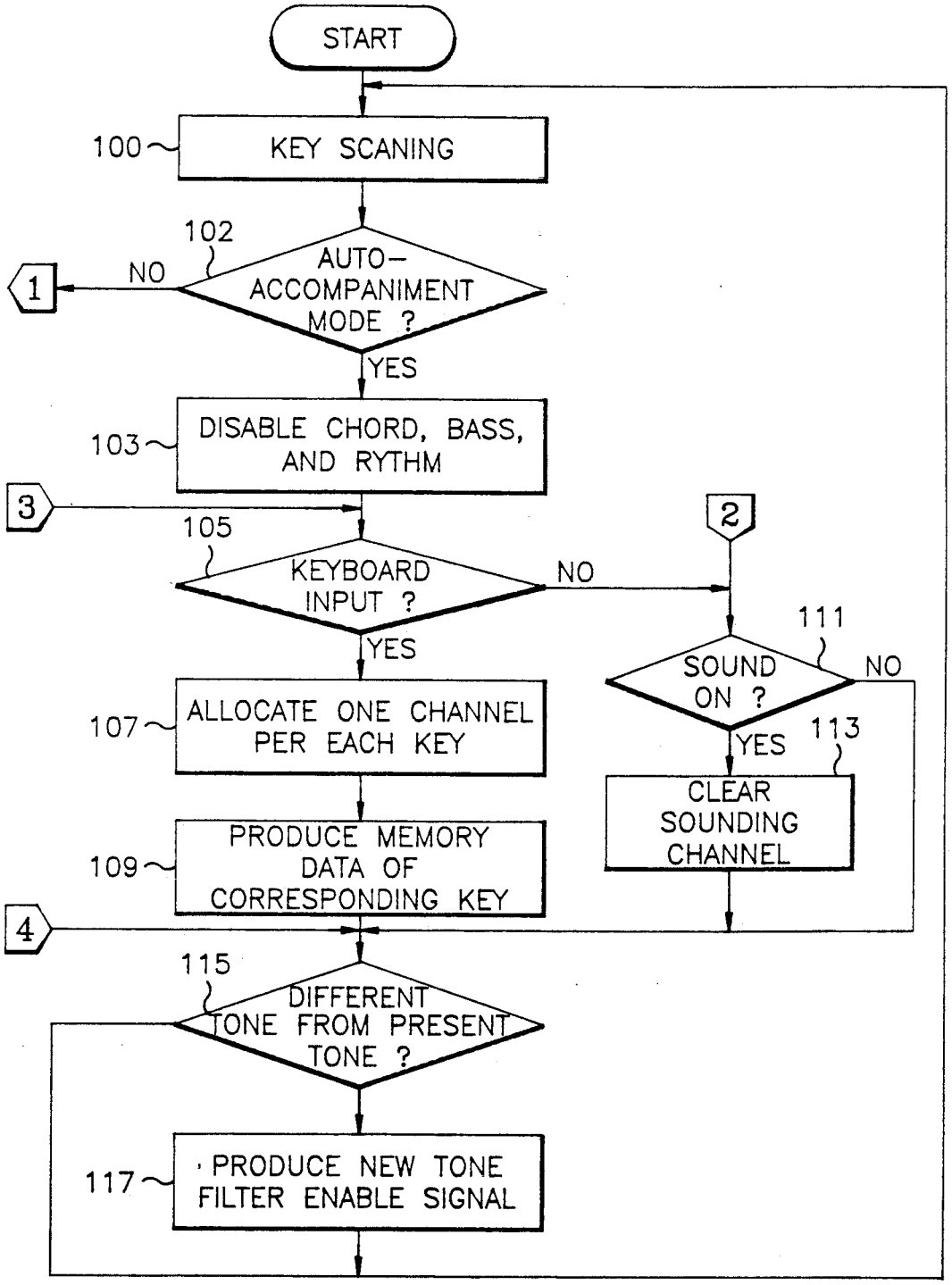
FIGS. 4(*a* and *b*) shows a flow chart for the duet-sound generation according to the invention.
Figure 4B:
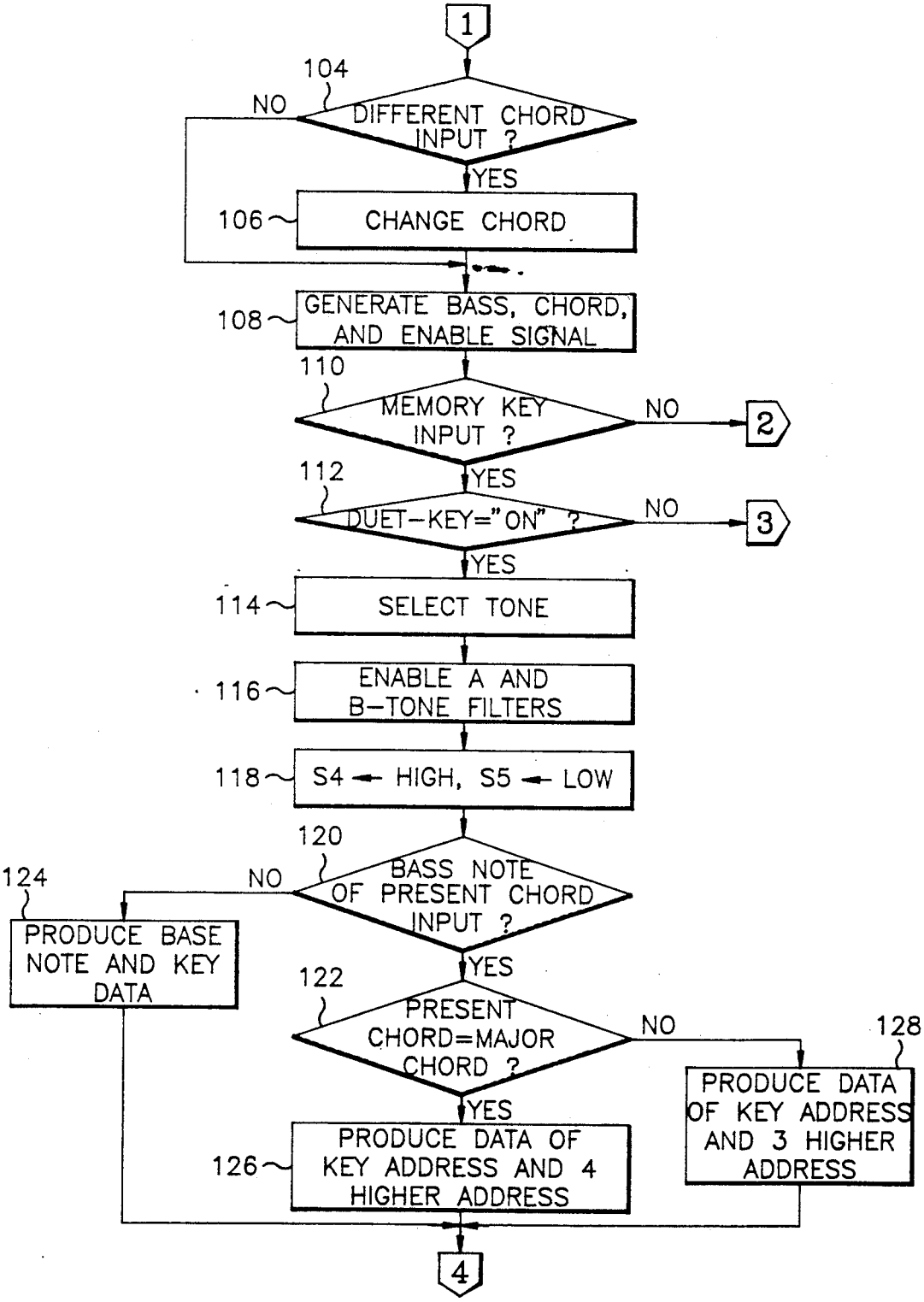

A flow chart specifically illustrating the dual voice, dual filter duet-sound generation is shown in FIG. 4*a*, if a melody keyboard note is depressed during the auto-accompaniment mode and the duet-switch 15 is "on", the corresponding flow diagram 4(*a*) is as explained hereinbelow. That is, in a first step, the selected filter control signal is output to enable the first 45 and the second 47 filters 116. Then, at a second step, a signal path is formed 118 to input a first note harmonized with a second note, which is the duet-sound, to the first 45 and second 47 filters. The melody keyboard 17 is then checked for a root note for the currently output chord 120 is then checked for being depressed. In a third step, if judged to have not been depressed, the equivalent to the root notes of the currently output chord and the depressed melody keyboard note, is generated 124 and sent through the path formed in the second step to the first and the second filters 45, 47. If the melody keyboard note corresponding to the root note of the second step is being played, at a fourth step, a currently played chord is checked if it is a major chord, 122. Thereafter, at a fifth step, the data for each sound is transmitted so that the notes depressed for the major key chord and a generated note a major third from the melody note are outputted 126 to the output terminals OUT1 and OUT2 of the sound-generator IC 21. Then, at the sixth step, if the checking result of the fourth step turns out not to be a major key, the data for each note is transmitted so that the melody note depressed and a generated note a minor third, 128 from the melody note can be output to the output terminal OUT1, OUT2 of the sound-generator IC.

Now, assuming that the output terminal OUT1 or OUT2 of the sound-generator IC 21 in FIG. 3 has five tone-generation channels, further explanation will be given about this invention in accordance with the accompanying drawings.

If the auto-accompaniment switch 13 of FIG. 3 is "off", it is not judged as the auto-mode in checking procedure 102 and the duet mode is not executed even if the duet switch 15 is turned "on". Therefore, if the system is not in the auto-accompaniment mode in the checking step 102, the microcomputer 11 outputs logic "low" signal through the output terminals S7 and S8 and disables the chord and bass filter 41 and the rhythm generator 43 in a step 103. On the other hand, a logic "high" signal is outputted through the output terminal S4, S5 and S6 to enable the first, second, and third buffer 23, 25, 27, respectively.

As shown above, since when the system is not in the duet mode, the sound is generated only from the output terminal OUT1 of the sound-generator IC 21, under the control of the microcomputer 11, the output signal from the sound generator IC 21 is applied only to the A-tone filter one, 45 according to the filter selection switch 19. The switching operation of the Filter-Selection switch 19 can change the filter selection.

According to FIG. 3, if the auto-accompaniment selection switch 13 is turned "on" to the C-chord, the duet switch 15 is turned "off" and the filter selection switch 19 is set for Filter One, the output terminals S1–S8 of the microcomputer outputs the signals as shown in the following Table 1-1 and the data transmitted to the sound-generation IC 21 are outputted as in the Table 1-2 according to the note selection on melody keyboard 17.

TABLE 1-1

| Control Signal Status | | | | | | | | |
|---|---|---|---|---|---|---|---|---|
| S1 | S2 | S3 | S4 | S5 | S6 | S7 | S8 | H: High |
| H | L | L | H | L | L | H | H | L: Low |

TABLE 1-2

| | Channel Data | | | | |
|---|---|---|---|---|---|
| Channel | 1 | 2 | 3 | 4 | 5 |
| Data | Do (root note) | Mi (third) | Sol (fifth) | | |

The Table 1-1 and 1-2 shows the channel allocation and the situation for each control signal when Filter One is selected and a C-chord is generated. In this case, since the output terminals S1, S4, S7 and S8 of the microcomputer are logic "high", the filter One, 45, the chord and bass filter 41, and the rhythm generator 43 are enabled. Besides, the output of the first buffer 23 is applied only to filter One, 45 by the logic "high" signal of the output terminal S4 of the microcomputer 11.

If the channel data as shown in the Table 1-2 are inputted to the sound-generator IC 21, a fourth channel and fifth channel data are produced from its output terminal OUT1 to be input to the filter One, 45, while the chord sound of the first, second, and third channel is output from the output terminal OUT3.

Accordingly, the chord sound is input to the chord and bass filter 41 according to steps 104, 106 and 108 of FIG. 4*a*, and the melody keyboard notes of the fourth and fifth channels are generated through steps 110 and 112, and through 107, 109, 115 and 117.

Meanwhile, if the auto-accompaniment switch 13, the melody keyboard 17 and the duet switch 15 are "on" and the Filter Selection switch 19 is sequentially set to the Filter One and Filter Two the microcomputer 11 scanning these states outputs the control signals with conditions as in the following Table 2-1 to each output terminal and outputs the channel data as in the following Table 2-2.

TABLE 2-1

| Control Signal Condition | | | | | | | | |
|---|---|---|---|---|---|---|---|---|
| S1 | S2 | S3 | S4 | S5 | S6 | S7 | S8 | H: High |
| H | H | L | H | L | L | H | H | L: Low |

TABLE 2-2

| | Channel Data | | | | |
|---|---|---|---|---|---|
| Channel | 1 | 2 | 3 | 4 | 5 |
| Data | Root Note of Chord note | a musical third | a musical fifth | a melody keyboard note using Filter One | duet note using Filter Two |

As Filter One and Filter two are sequentially selected through the Filter Selection switch 19 as shown above, the control signal is outputted as in the above Table 2-1 to select and enable the filters 45, 47. The first and fifth buffer 23, and 31 are enabled in a step 118.

If the auto-accompaniment switch 13, melody keyboard 17, and Filter selection switch 19 are switched as described above and only the duet switch is turned "on", the system is in a mono-instrument voice duet mode. The microcomputer 11, then, outputs the control signal conditioned as in the Table 3-1 to enable only filter One, 45 and output the channel data as in the Table 3-2.

TABLE 3-1

| Control Signal Condition | | | | | | | |
|---|---|---|---|---|---|---|---|
| S1 | S2 | S3 | S4 | S5 | S6 | S7 | S8 |
| H | L | L | H | L | L | H | H |

TABLE 3-2

| | Channel Data | | | | |
|---|---|---|---|---|---|
| Channel | 1 | 2 | 3 | 4 | 5 |
| Date | (Do) Root note of chord | (Mi) a musical third note | (Sol) a musical fifth note | melody keyboard note using Filter One | duet note also using Filter One |

As shown in the Table 3-1, only the output terminal S1 of the microcomputer 11 is "on", enabling only Filter One filter 45. Additionally, as the output terminal S4 is "high", the Filter One filter 45 receives the sound source from the terminal OUT1 of the sound-generator IC.

On the other hand, the output terminal S7 and S8 of the microcomputer 11 are logic "high", causing the chord and bass filter 41 and the rhythm generator 43 to output as described above. Moreover, the first, second, and third channel data of the above Table 3-2 are the chord data. Those are output to the output terminal OUT3 when inputted to the sound-generator IC 21.

The data of the fourth and fifth channel are melody keyboard note data. If the melody keyboard note corresponding to a "Do" sound is depressed, the current chord is a C-chord. The corresponding "Do" sound is allocated to the fourth channel and "Mi" sound is allocated to fifth the channel to effect, the duet-sound as shown in Table 3-2. If current chord is a major key and the melody note played is equivalent to the chord's root note, the fifth channel is allocated with a note that is major third interval from melody note played. It resulting in a duet effect. Meanwhile, if the current chord is a minor chord and the melody note played is equivalent to its root note, then channel 5 is allocated with the first melody note and a note that is at a minor third interval from this first melody note. For selection of the duet-sound, operation is similar in both the mono-voice and dual voice mode.

As shown hereinbefore throughout the specification, this invention employs three-state buffers between the output of the sound-generator IC and the plurality of the filters. Therefore, this invention has an advantage of generating a double-voice, dual filter duet-sound by controlling the three-state buffer and filters in response to the duet and filter selection.

While the invention has been particularly shown and described with reference to a preferred embodiment, it will be understood by those skilled in the art that modifications in detail may be made without departing from the spirit and scope of the invention.

What is claimed is:

1. A dual filter duet-sound generating method for an electronic musical instrument, said method comprising:

a first step for enabling a plurality of filters in response to a filter control signal applied from a microcomputer;

a second step for forming a signal path for applying said duel filter duet sound, to said plurality of filters and checking if a melody keyboard note, of a sound corresponding to a root note of a chord presently being generated, is being played;

a third step for, if said melody keyboard note in said second step does not correspond to said root note, then generating a signal corresponding to both said melody keyboard note and said root note through a signal path formed in said second step;

a fourth step for checking if said chord is a major chord, when said melody keyboard note in said second step is being played;

a fifth step for, if said chord is a major chord in said fourth step, then controlling said microcomputer to generate a signal corresponding to said melody keyboard note and another signal four melody keyboard notes higher in pitch than said melody keyboard note, to an output terminal of a sound-generator; and a sixth step for, if said chord is not said major chord in said fourth step, then controlling said microcomputer to generate a sound corresponding to said melody keyboard note and another sound three melody keyboard notes higher in pitch than said melody keyboard note to an output terminal of said sound-generator.

2. An electronic musical instrument, comprising:

musical note selecting means, for supplying note signals corresponding to selection of musical notes from among a plurality of musical notes;

first function selection means, for supplying a first function enabling signal corresponding to selection of a first automated musical function;

second function selection means, for supplying a second function enabling signal corresponding to selection of a second automated musical function;

filter selection means, for supplying a filter enabling signal corresponding to selection of a filter among a plurality of filters;

control means, coupled to said musical note selecting means, to said first function selection means, to said second function selection means and to said filter selection means, for producing a plurality of control signals in response to said selection of musical notes, to said selection of said first and second automated musical functions, and to said selection of a filter;

sound generator means, coupled to said control means, for generating sound signals in response to said control signals;

a plurality of buffers;

said plurality of filters being each coupled through different buffers of said plurality of buffers to said sound generator means, to produce filtered sound signals at a common node, each filter of said plurality of filters having an enabling control terminal coupled to said control means, each buffer of said plurality of buffers being coupled to respond to said control signals;

a chord and bass filter, coupled to said sound generator means, to produce chord and bass filtered sound signals, said chord and bass filter being coupled to respond to said control signals; and a rhythm generator for generating musical rhythm sound signals and being coupled to respond to said control signals.

3. The electronic musical instrument of claim 2, wherein said musical note selecting means comprises a musical keyboard of keys.

4. The electronic musical instrument of claim 2, wherein said first function selection means comprises a switch, and said first automated musical function comprises an auto-accompaniment musical function.

5. The electronic musical instrument of claim 2, wherein said second function selection means comprises a switch, and said second automated musical function comprises a duet note musical function.

6. The electronic musical instrument of claim 2, wherein said filter selection means comprises a selection switch, and each said filter of said plurality of filters produces a sound signal corresponding to sounds associated with a particular musical instrument;

7. The electronic musical instrument of claim 2, wherein:

said control means comprises a first integrated circuit having a plurality of output control terminals producing said control signals;

said sound generator means comprises a second integrated circuit of five channels with each of said channels being able to generate notes, said second integrated circuit having a first output terminal commonly connected to each filter of said plurality of filters through first, second, and third buffers, respectively, of said plurality of buffers, said first buffer having an enabling control terminal coupled to a first output control terminal of said plurality of output control terminals, said second buffer having an enabling control terminal coupled to a second output control terminal of said plurality of output control terminals, said third buffer having an enabling control terminal coupled to a third output control terminal of said plurality of output control terminals; and said second integrated circuit having a second output terminal commonly connected to each filter of said plurality of filters through fourth, fifth, and sixth buffers, respectively, of said plurality of buffers, said fourth buffer having an enabling control terminal coupled through a first inverter to said first output control terminal of said plurality of output control terminals, said fifth buffer having an enabling control terminal coupled through a second inverter to said second output control terminal of said plurality of output control terminals, said sixth buffer having an enabling control terminal coupled through a third inverter to said third output control terminal of said plurality of output control terminals.

8. A method of controlling an electronic musical instrument having an auto-accompaniment musical function and a duet note musical function, comprising the steps of:

activating said auto-accompaniment musical function to produce musical chord accompaniment to a selected note selected by the musician;

activating said duet note musical function;

activating a first filter and a second filter, each coupled to a sound generator means and also coupled to a control means, to provide signals corresponding to musical notes;

generating a signal corresponding to said selected note;

automatically generating a duet note harmonized to said selected note by using said duet note musical function;

controlling said filters and input signals to said filters to supply both said first filter and said second filter with both said signal corresponding to said selected note and a signal corresponding to said duet note;

automatically generating a root note of said musical chord accompaniment and supplying both said first filter and said second filter with both a signal corresponding to said root note and said signal corresponding to said selected note, if said root note was not a selected note;

automatically generating a major note, said major note being a major-third interval from said selected note, and supplying both said first filter and said second filter with both a signal corresponding to said major note and said signal corresponding to said selected note, if said root note was a selected note and said musical chord accompaniment was a major chord; and automatically generating a minor note, said minor note being a minor-third interval from said selected note, and supplying both said first filter and said second filter with both a signal corresponding to said minor note and said signal corresponding to said selected note, if said root note was a selected note and said musical chord accompaniment was a minor chord.

* * * * *

UNITED STATES PATENT AND TRADEMARK OFFICE

CERTIFICATE OF CORRECTION

PATENT NO. : 5,166,465

DATED : 24 November 1992

INVENTOR(S) : Ik-Bom Jeon

It is certified that error appears in the above-indentified patent and that said Letters Patent is hereby corrected as shown below:

IN THE TITLE PAGE

Title [54] before "Duet-Sound" insert --Dual Filter--;

Abstract [57] Line 6, after "in" insert --a--;

Line 8-9, before "11" change "microputer" to --microcomputer--;

Column 1 Line 2, before "Duet-Sound" insert --Dual Filter--;

Column 1 Line 28, before "43" delete "a"; before "rhythm" insert --a--;

Column 1 Line 37, before "for" change "chart" to --charts--;

Column 1 Line 50, before "performs" insert --and--;

Column 2 Line 29, after "major" delete "key"; before "minor" delete "a";

Column 2 Line 30, before "Thereafter" change "key" to --chord--; after "for" delete "harmonious";

Column 2 Line 31, after "minor" delete "key responding";

Column 3 Line 50, before "same" insert --the--;

UNITED STATES PATENT AND TRADEMARK OFFICE

CERTIFICATE OF CORRECTION

PATENT NO. 5,166,465
DATED 24 November 1992
INVENTOR(S) Ik-Bom Jeon

It is certified that error appears in the above-indentified patent and that said Letters Patent is hereby corrected as shown below:

Column 3 Line 52, after "Fig. 4a" change ", if" to --. If--;

Column 4 Line 36 after "the" (2nd occurrence) delete "A-tone";

Column 4 Table 1-2, Line 58-59, under "Channel 4" and "Channel 5" insert --melody keyboard note--;

Column 5 Line 17, before "Filter One" delete "the";

Column 6 Line 21, after "is" (2nd occurrence) insert --a--;

Column 6 Line 22 after "played" change ". It" to --,--:

Signed and Sealed this

Twenty-fifth Day of March, 1997

*Attest:*

*Attesting Officer*

BRUCE LEHMAN

*Commissioner of Patents and Trademarks*